US005943882A

United States Patent [19]

Erb

[11] Patent Number: 5,943,882

[45] Date of Patent: Aug. 31, 1999

[54] SELF SIZING RING

[76] Inventor: Jean-François Albert Erb, Quito, Newport Beach, Calif. 92663

[21] Appl. No.: 09/186,571

[22] Filed: Nov. 5, 1998

[51] Int. Cl.[6] ..... A44C 9/02

[52] U.S. Cl. ..... 63/15.5; 63/15.6

[58] Field of Search ..... 63/15.45, 15.5, 63/15.6, 15.65

[56] References Cited

U.S. PATENT DOCUMENTS

| | | | |
|---|---|---|---|
| 175,057 | 3/1876 | Eisele | 63/15.65 |
| 274,193 | 3/1883 | Henrich | 63/15.65 |
| 293,044 | 2/1884 | Lewkowitz | 63/15.65 |
| 293,874 | 2/1884 | Henrich | 63/15.65 |
| 294,277 | 2/1884 | Schindler | 63/15.65 X |
| 322,435 | 7/1885 | Foster . | |
| 803,273 | 10/1905 | Davidoff . | |
| 1,558,418 | 10/1925 | Wendel . | |
| 1,695,157 | 12/1928 | Quast | 63/15.65 |
| 2,146,272 | 2/1939 | Skoog . | |
| 2,961,855 | 11/1960 | Newman | 63/15.65 |
| 2,966,048 | 12/1960 | Goossev . | |
| 3,246,388 | 4/1966 | Pasquale | 63/15.65 X |
| 3,959,989 | 6/1976 | Bhandia . | |
| 4,261,185 | 4/1981 | Martinez | 63/15.6 |

FOREIGN PATENT DOCUMENTS

| | | | |
|---|---|---|---|
| 802 | of 1884 | United Kingdom . | |
| 18619 | 8/1904 | United Kingdom | 63/15.65 |

*Primary Examiner*—Terry Lee Melius
*Assistant Examiner*—Andrea Chop
*Attorney, Agent, or Firm*—Price Gess & Ubell

[57] ABSTRACT

A self sizing adjustable jewelry ring includes a shank member configured to encircle a substantial portion of the finger and to be open on one side. A bridge member is permanently connected to the shank member but permits a movement relative to the shank member as it extends across the open side. One of the shank member and the bridge member has a pair of slots for respectively receiving a portion of the other member to prevent their separation. The shank member and the bridge member are dimensioned to provide a spring force between them wherein the bridge member can be moved relative to the shank member to adjust for the size of the user's finger.

22 Claims, 4 Drawing Sheets

SELF SIZING RING

BACKGROUND OF THE INVENTION

1. Field of the Invention

The present invention is directed to an improvement in jewelry and more specifically an improvement in an adjustable self sizing ring.

2. Description of Related Art

Numerous attempts have been made in the prior art to provide adjustable finger rings to accommodate or fit fingers of various sizes. Traditionally, making a ring larger or smaller has been an ordeal for the jeweler, primarily because the resizing process has required removing the gemstone. Additionally, stretching or cutting down the band may introduce imperfections into the metal or weaken the overall ring structure. Some of the early approaches to this problem have been to provide ring protectors that assist in adjusting the opening of a finger ring with a flexible band, such as shown in U.S. Pat. No. 803,273.

It is well known that a ring can frequently require an adjustment even if initially sized to a particular finger due to physiological changes that can occur such as the wearer's weight and changes in the weather. U.S. Pat. No. 2,966,048 discloses a ring guard for a diamond engagement ring that also purportedly prevents any twisting through the particular structure of a ring guard formed from a plastic material. U.S. Pat. No. 322,435 discloses an ability to adjust a flexible open circular band with pivoted cams. U.S. Pat. No. 1,558,418 discloses a ring that is bifurcated so that hooks on upper edges of a shank can be mounted within keeper openings on a head of the ring. U.S. Pat. No. 2,146,272 discloses procedure for adjusting a bifurcated ring arrangement wherein hooks are provided on a head of the ring for interfacing with indents on a shank.

Finally, the British Patent No. 802 (1884) and U.S. Pat. No. 3,959,989 are of general interest.

Although the prior art has attempted, for a considerable period of time, to resolve the problem of adjusting a size of a ring for jewelry applications there is still a demand in the commercial jewelry field to provide an efficient and secure adjustment of ring for use in fine jewelry.

SUMMARY OF THE INVENTION

The present invention is directed to a two-part adjustable jewelry ring assembly that can provide a high degree of security so that it can be utilized in an attractive manner in fine jewelry accessories. The adjustable jewelry ring includes a band or shank member that is configured to encircle a substantial portion of the user's finger and to be open on one side. A bridge member is permanently connected to the shank member but is movable relative to the shank member to extend across the open side of the shank member. The bridge member can be decorated or adorned with fine jewels that can be safely and permanently secured to the shank member. One of the shank member and the bridge member can include a pair of elongated slots for respectively receiving a portion of the other member to prevent their separation. The shank member or bridge member are further dimensioned to provide a spring force between the shank member and the bridge member wherein the bridge member can be moved relative to the shank member to adjust for the size of the user's finger and held at that position while being permanently secured to the shank member. The spring force is sufficient to maintain a snug fit on the user's finger while at the same time permitting the bridge member to be moved to assist in an ease of removal across the joint of the user's knuckle.

The shank member can include a lower base portion from which cantilevered side members extend upward to provide a natural rectangular shape complimentarily to the shape of a human finger. The cantilevered side members can have a slot with a relatively planar exterior side configuration and can include upper ends on the respective side members which can be bent inward to extend across a portion of the bridge member.

The shank member can, in one embodiment, have interior dovetail slots to receive dovetail keeper members that are mounted on the bridge member. In another embodiment, the shank member can be hollow with elongated slots on the interior side surface to movingly capture keeper members in the hollow interior.

The present invention can accommodate slots placed either in the bridge or slots placed in the shank with the other member of the two-pieced ring assembly extending through the slots to permit a relative movement of the bridge member. The shank member can be made of a relatively flexible metal such as sheet gold, platinum, silver or other material that is traditionally used in jewelry. Flexibility in the material permits a sufficient spring force to be exerted as a result of the dimensioning of both the shank and the bridge portion of the ring assembly whereby a frictional contact can maintain the adjusted position of the bridge on an individual user's finger. As a result of this arrangement, the bridge member can be snugly fit on the individual user's ring finger to a greater extent than would occur in a normally static ring configuration while at the same time permitting an adjustment of the bridge to ensure an ease in removal of the ring.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings: this is one of the general paragraphs and the next is another.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principals of the present invention have been defined herein specifically to provide a self sizing ring assembly.

Figure 1:
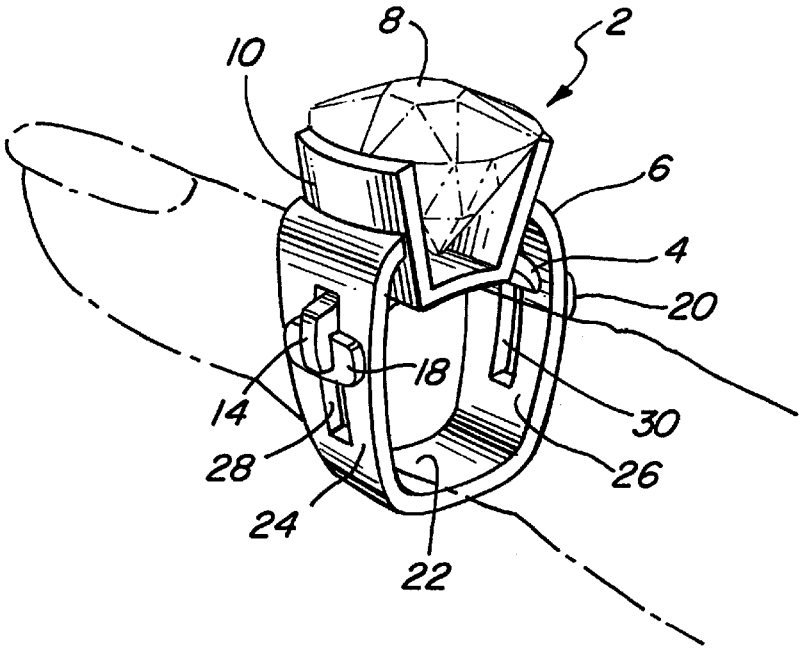
FIG. 1 is a perspective view of a first embodiment of the present invention with the bridge member elevated to permit the user's finger to be inserted.
Figure 3:
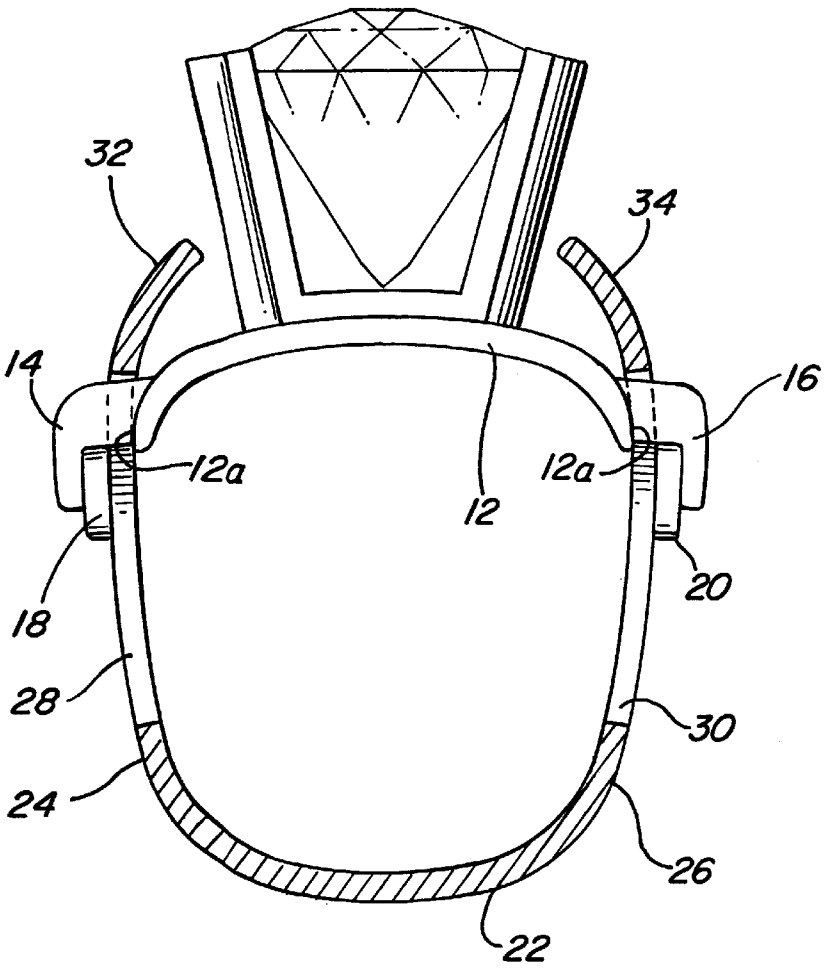
FIG. 3 is a partial side cross-sectional view of the first embodiment of the present invention with the bridge member in the enlarged position.

In referring to FIG. 1, the adjustable jewelry ring assembly 2 of the present invention includes a bridge member 4 and a shank member 6. The adjustable ring of the present invention is particularly applicable to fine jewelry that may contain expensive gemstones, such as a diamond which can be mounted in a setting 10 that can be firmly attached to the bridge member 4. As can be seen in FIG. 3, the bridge member 4 can have an arcuate shape to appropriately conform to the upper surface of the user's finger. This arcuate portion 12 can be attached to respective extension members 14, 16 that are appropriately dimensioned to accommodate elongated slots or apertures, to be discussed subsequently, with regards to the shank member 6. Mounted on each of the extension members 14, 16 is a securement member 18, 20 that will provide a load bearing surface to frictionally engage the exterior surface of the shank member 6 and to permanently secure the bridge member 4 to the shank member 6.

As can be readily appreciated, the bridge member 4 as disclosed in the first embodiment can be formed from five separate individual component parts. However, it is also possible to integrally form the bridge member 4 from at least one or two pieces of metal components. For example, the securement member 18, extension member 14, arcuate portion 12 and extension member 16 can be intricately cast or formed as an integral unitary component and then the plate member 20 could be installed after the integral member is mounted within the shank member 6. Various other configurations of the bridge member can be utilized while still achieving the purposes of the present invention.

Figure 2:
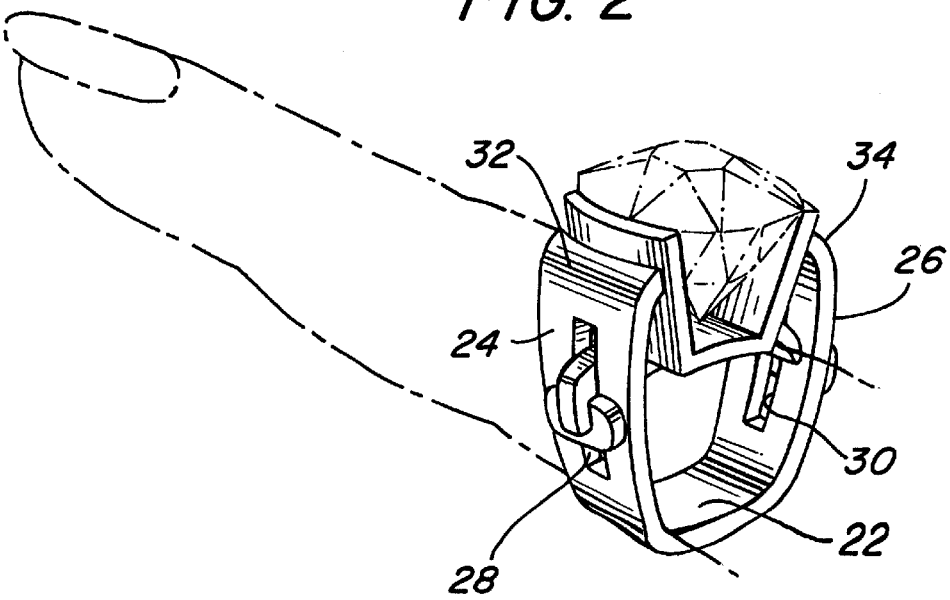
FIG. 2 is a perspective view of the ring assembly of the present invention with the bridge member fitted to the user's finger.

The setting 10 also can be subjectively configured within the creative ability of the jeweler and accordingly the particular setting 10 shown in the present embodiment should not be construed as being limiting. As shown in FIG. 1 and FIG. 2, the setting is proportioned to compliment the upper arcuate edge of the shank member 6 in both the uppermost and lowermost size adjustments, thus assuring an attractive presentation regardless of the adjustment.

Figure 4:
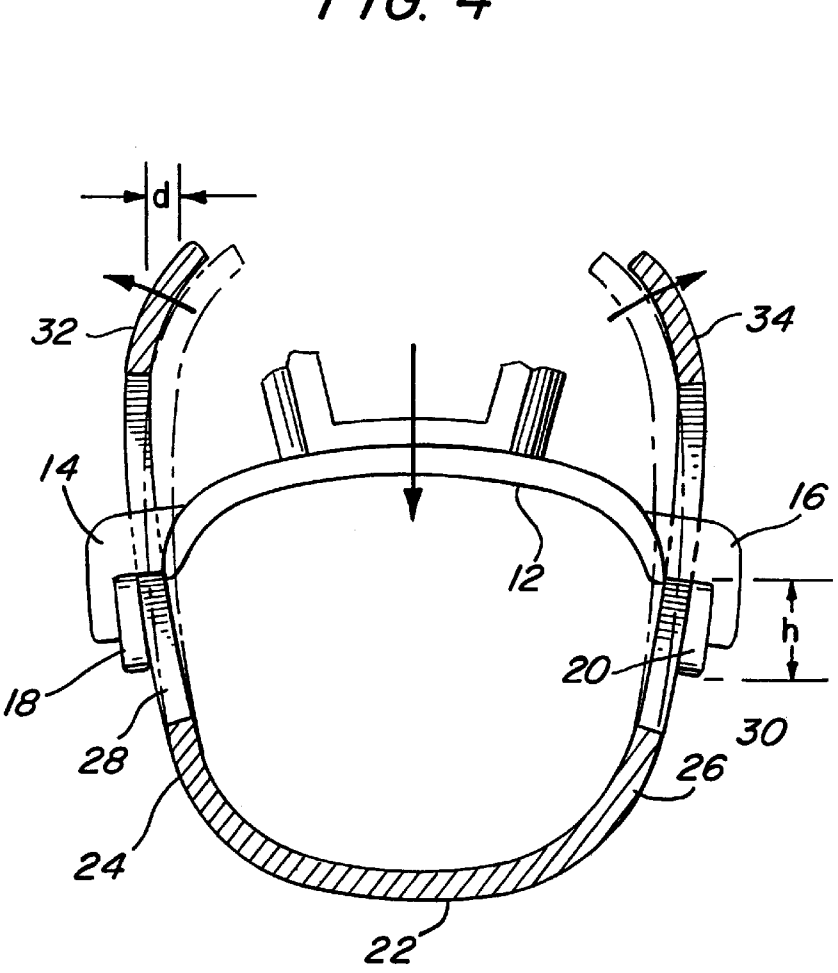
FIG. 4 is a partial side cross-sectional view with the bridge member retracted.

Referring to FIG. 1, the bridge member 4 is moved to its upper position so that the extension members 14, 16 are approximately at the upper end of the elongated slots or apertures 28, 30. In this position, the ring can easily pass over the knuckle joint of the illustrated user's finger. FIG. 2 discloses the position of the bridge member 4 when it has been pressed downward to snugly fit on the user's finger. As can be seen in FIG. 4, the side members 24, 26 of the shank member 6 are biased outward to create a frictional force between the respective side members 24, 26 and the respective load bearing securement members 18, 20. The relative movement or displacement, d, can be approximately in the range of 0.3 millimeters on each side. This total displacement however can maintain a sufficient frictional force regardless of whether the bridge member 4 is in its uppermost position or in its lowermost position. Additionally, the vertical height, h, of the respective securement members 18, 20 are sufficient to prevent any tilt of the bridge member 4 so that it maintains a substantially constant horizontal position as it is vertically adjusted. If the vertical height of the securement members 18, 20 are narrowed sufficient to provide simply a pivot point, the bridge member 4 could then be positioned askew relative to its shank member 6 to create a flaw in the symmetry of the two part adjustable ring assembly 2 between its range of movement. While the securement members 18, 20 are shown as plate members, other configurations could be used, including a set gemstone.

The shank member 6 can be appropriately heat treated to provide a spring force of an appropriate amount depending on the metals used. The shank member 6 can be biased outward or inward relative to the bridge member 4. When the shank member 6 is biased outward the securement members 18, 20 can force the shank member 6 inward during adjustment as seen in FIGS. 3 and 4. However, it is also possible to have the bridge member 4 force the shank member 6 outward as it moves vertically upward, that is the shank member 6 can be designed to be biased inward relative to the dimension of the bridge member 4. In this case, the edges 12*a* of the arcuate portion 12 will press against the interior surfaces of the shank member 6 adjacent the respective slots 28, 30 and the load plate number 18, 20 are only used for a locking purpose. One advantage of the biasing inward of the shank member 6 is that any possible wear or scouring of the surface of the shank member 6 by a large number of bridge member 4 adjustments will be on the interior of the ring 2 and therefore not seen by the user.

The disclosure of FIGS. 3 and 4 represents a range of adjustment wherein FIG. 3 will accommodate a size 8 ring measurement, so that the vertical internal opening height will be approximately 18.2 millimeters, while the internal opening width will be 16.3 millimeters. The actual exterior width of the shank member 6 displacement will be 19.2 millimeters when it is a size 8. In FIG. 4, the same ring assembly 2 is now adjusted to a size 4.5 with the exterior width of the shank member being 19.5 millimeters, its internal opening height being 13 millimeters and its internal opening width being 16.4 millimeters. To give a perspective as to the dimensions of the shank member 6 relative to the bridge member 4, the shank member 6 had a open width of 22 millimeters before the bridge member 4 was permanently installed through the respective elongated apertures. Thus, a relatively constant spring force is maintained on the bridge member 4 in view of the dimensions of the shank member 6 and the bridge member 4 as depicted in FIGS. 3 and 4. As a result, the user of the ring when moving the ring 2 as shown in FIGS. 1 and 2 will experience a relative constant force during the securement of the bridge member 4 during the mounting of the ring onto the finger and an adjustment to a secure fit.

Figure 5:
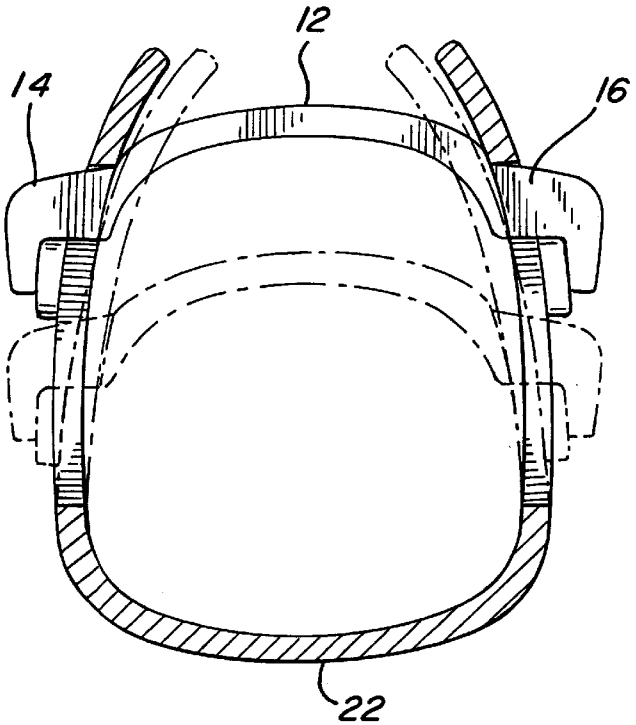
FIG. 5 is a partial side cross-sectional view of the ring assembly.

FIG. 5 discloses a cross-sectional view of the combination of the bridge member 4 and the shank member 6 to disclose the relative displacements that can be achieved.

Figure 6:
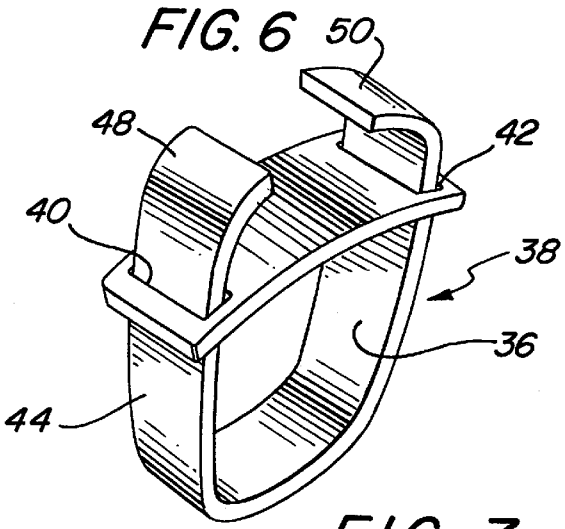
FIG. 6 is a prospective view of a second embodiment of the present invention.

FIG. 6 discloses an alternative embodiment of the present invention and includes a shank member 36 with a bridge member 38 permanently attached in a movable manner to the shank member 36. The bridge member 38 includes elongated apertures 40, 42 that are dimensioned to closely fit the side members 44, 46 of the shank member 36. In this embodiment, the ends 48, 50 of the respective side members 44, 46 are bent a sufficient angle to ensure that the bridge member 38 cannot be removed from the shank member 36. The outer surfaces of the respective apertures 40, 42 serve the purpose of providing a frictional bearing load between the spring force of the side members 44, 46 relative to the bridge member 38. Thus, the same principles of having a permanent bridge member that can be frictionally positioned for an adjustment is provided in this embodiment of the present invention. Needless to say, an appropriate setting can be provided for the bridge member 38. Additionally, the shank member 36 itself can also carry additional jewels to complement any setting. It would also be possible to dimension the exterior width of the shank member 36 in an unstressed state that would be smaller than the distance between the slots 40, 42 so that the bridge member 38 provides a spring force by pushing the side members 44 and 46 apart.

Figure 7:
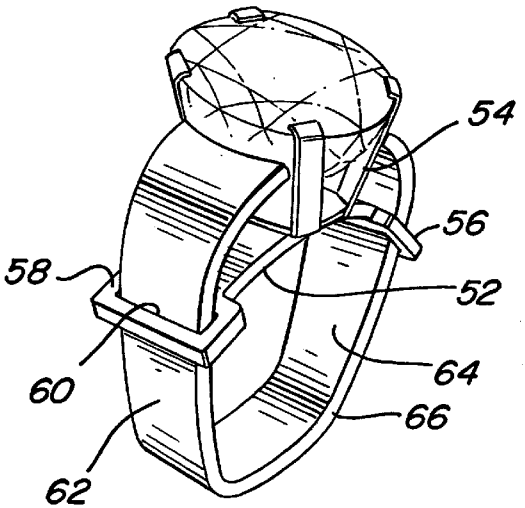
FIG. 7 is a perspective view of a third embodiment of the present invention.

A third embodiment of the present invention, which is similar in operation to that of the second embodiment, is shown in FIG. 7. In the third embodiment the bridge member 52 has a reduced width and is complemented with an appropriate prong setting 54 that is mounted on the bridge member 52. Respective ends of the bridge member 52 have enlarged portions 56, 58 with appropriate slots or elongated apertures 60 for providing a frictional force to side members 62, 64 of the shank member 66.

Figure 8:
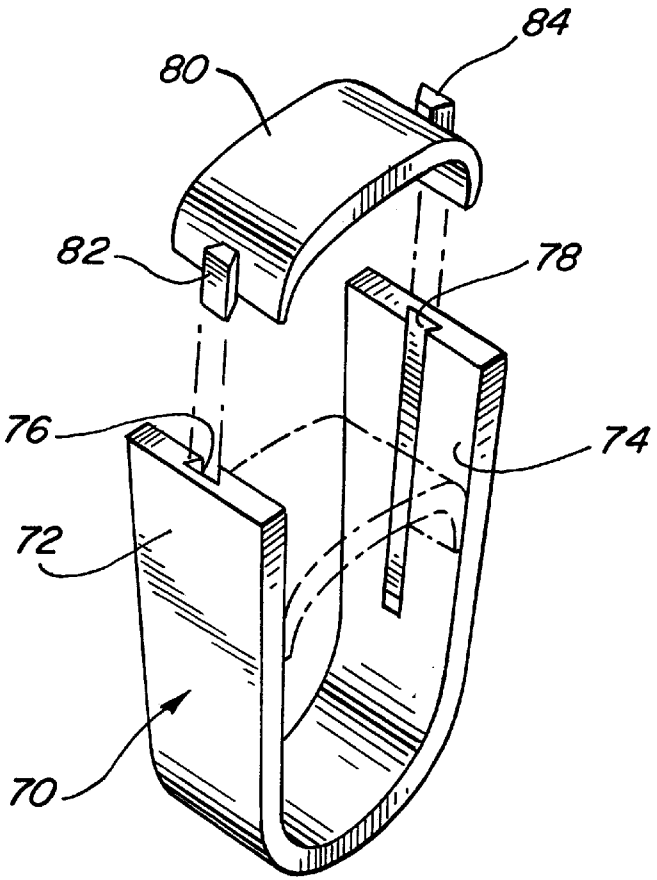
FIG. 8 is a perspective view of a fourth embodiment of the present invention.

FIG. 8 discloses a fourth embodiment of the present invention and includes a shank member 70 having side members 72, 74 that are biased inward against a bridge member 80. As the bridge member 80 moves vertically along the side members from a lower to an uppermost position, it forces the side members 72, 74 outward to increase the finger size of the ring. The internal surfaces of the respective side members 72, 74 have an elongated dovetail slots 76, 78 respectively. Securement members 82, 84 are mounted on the bridge member 80 of a complimentary size to be retained within the respective dovetail slots 76, 78.

Bridge member 80 is disclosed in an exploded perspective view to illustrate the configuration of the securement members 82, 84. The outer edge surfaces of the bridge member 80 actually bear against the planar interior surfaces of the side members 72, 74 to provide a secure spring force for holding a desired adjustment. While the dovetail slots or grooves are shown extending to the top of the respective side members 72, 74 it should be understood that once the bridge member 80 is mounted in the shank member 70 that the dovetailed slots are then closed at the top to leave an elongated slot that permits limited travel movement of the bridge member 80. Other configurations of grooves than a dovetail arrangement can be used.

Figure 9:
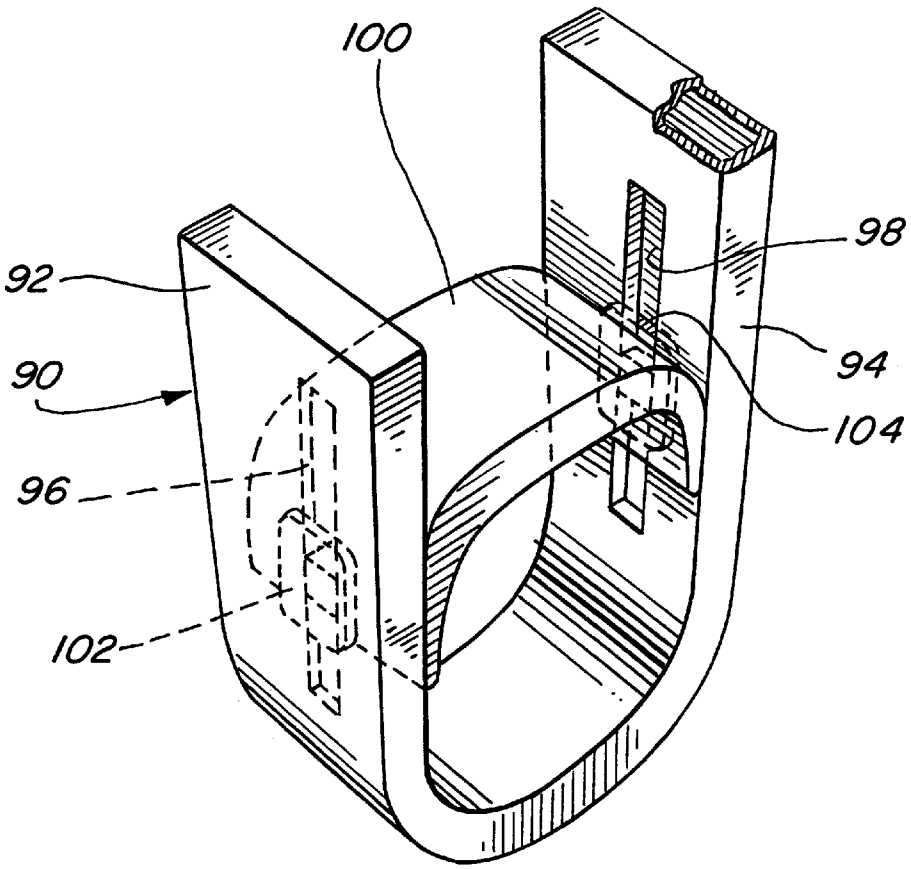
FIG. 9 is a perspective view of a fifth embodiment of the present invention.

A fifth embodiment of the present invention is shown in FIG. 9 in a perspective view. A shank member 90 can include a pair of rectangular cross-sectional hollow side members 92, 94. The side members have elongated slots 96, 98 respectively on their interior surfaces. A bridge member 100 is mounted between the respective side members 92, 94 and further includes keeper members 102, 104 that are captured within the hollow interior of the respective side members 92, 94. The keeper members 102, 104, as shown, can be in the form of plates that either act only to maintain a securement of the bridge member 100 to the shank member 90 or, alternatively, can provide load bearing surfaces against the interior planar surfaces of the side members 92, 94. The function of the respective keeper members 102, 104 will depend upon whether the side members 92, 94 are spring biased inward or spring biased outward. If the side members 92, 94 are biased outward, the respective keeper members 102, 104 will not only provide a securement, but will also provide a load bearing friction surface on the interior hollow planar surfaces of the respective side members 92, 94. If, however, the side members 92, 94 are biased inward, the respective ends of the bridge member 100 will provide the friction surface for exerting a force to open the side members 92, 94 as the bridge member 100 travels vertically upward. In this case, the keeper members 102, 104 will simply insure that the bridge member 100 is permanently mounted to the shank member 90.

The present invention is particularly useful on jewelry rings where the user must first be assured of the safety of securing an expensive jewel or semi-precious stone on the bridge member to the shank member. However, the same principles of this invention can be applied to a bracelet for securing it to a wrist or an appendage of a user.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. An adjustable jewelry device comprising:

a shank member configured to encircle a substantial portion of an appendage and open on one side with a respective shank end on either side of the open side; and a bridge member, movably connected to the shank member and being permanently secured to the shank member, said bridge member extending across the open side of the shank member such that said shank ends are free and extend completely outside of said bridge member, the shank member has a pair of elongated slots, one slot offset from either shank end for respectively receiving a portion of the bridge member to prevent separation of the bridge member from the shank member, the slots are aligned opposite to each other and extend in a longitudinal direction along an inner perimeter surface of the shank member, each slot having two opposite ends, said slots receiving the portion of the bridge member, the bridge member is adjustable between said opposite ends of said elongated slots, the shank member and the bridge member being dimensioned to provide a spring force between the shank member and the bridge member wherein when the bridge member is movably adjusted relative to the shank member the jewelry device will adjust for the size of a user's appendage.

2. The jewelry device of claim 1 wherein the shank member includes a pair of side members which are approximately planar adjacent the slots.

3. The jewelry device of claim 2 wherein the side members are cantilevered from a lower base portion of the shank member and are bent inward above the bridge member at their respective ends.

4. The jewelry device of claim 3 wherein the bridge member includes a setting assembly extending upward from the bridge member and the inwardly bent ends of the side members are positioned adjacent the setting assembly in both opposite end positions of the movement of the bridge member along the elongated slots.

5. The jewelry device of claim 2 wherein the bridge member has two ends and includes a load securement member at each end to frictionally press against the respective side members.

6. The jewelry device of claim 1 wherein the shank ends are bent inward by the bridge member as it is movably adjusted away from the shank ends.

7. The jewelry device of claim 1 wherein the shank ends are bent outward by the bridge member as it is movably adjusted away from the shank ends.

8. The jewelry device of claim 1 wherein the side members are hollow and the bridge member has two opposite ends and includes a keeper member at each end that is captured within the elongated slots on either inner perimeter surface of the shank member.

9. The jewelry device of claim 1 wherein the shank member has a pair of parallel grooves and the bridge member has a pair of complimentary keeper members captured in the grooves to permanently secure the shank member and the keeper members together.

10. An adjustable jewelry ring, comprising:

a shank member configured to encircle a substantial portion of a finger, the shank member is open on one side, the shank member having a lower base portion and a pair of side members extending flexibly upward from the base portion, each side member has an end and an inner and an outer surface with an elongated aperture extending through the side member from the inner surface to the outer surface; and a bridge member extending within and across the open side of the shank member, the bridge member is movingly captured between the respective elongated apertures by a pair of securement members that permanently mount the bridge member to the shank member, the dimensions of the bridge member and the shank member force the securement members into a frictional contact with the shank member adjacent the respective elongated apertures, the ends of the side members being free and extending completely outside of the bridge member whereby movement of the bridge member relative to the shank member along a length of the elongated apertures is used to adjust for the size of a user's finger.

11. The jewelry ring of claim 10 wherein the securement members have sufficient height to prevent a tilting of the bridge member as it moves along the shank member.

12. The jewelry ring of claim 10 wherein the side members are approximately planar adjacent the elongated apertures.

13. The jewelry ring of claim 10 wherein the side members are cantilevered from the lower base portion and are bent inward above the bridge member at their respective ends.

14. The jewelry ring of claim 13 wherein the bridge member includes a setting assembly extending upward from the bridge member and the inwardly bent ends of the side members are positioned adjacent the setting assembly in both an open and closed position of the movement of the bridge member.

15. The jewelry ring of claim 10 wherein the side members are bent inward by the bridge member as it moves toward the lower base portion.

16. The jewelry ring of claim 10 wherein the side members are bent outward by the bridge member as it moves toward the lower base portion.

17. The jewelry ring of claim 10 wherein the bridge member includes the load securement member at each end to frictionally press against the respective side members.

18. An adjustable jewelry ring, comprising:

a shank member configured to encircle a substantial portion of a finger and to be open on one side, the shank member having a lower base portion and a pair of side members extending flexibly upward from the base portion to provide a respective end member on each side member; and a bridge member extending across the open side of the shank member, one of the shank member and the bridge member has a pair of slots for respectively receiving a portion of the other member to prevent release from each other, each of the slots are elongated and extend completely through said one of the bridge member and the shank member whereby the portion of the other member extends completely through said slots from one external surface to an opposite external surface; the shank member and the bridge member being dimensioned to provide a spring force between the shank member and the bridge member wherein the bridge member can be moved relative to the shank member along the elongated slots to move the respective side members, the side members are biased relative to the bridge member to provide a sufficient spring force to frictionally hold the bridge member at a predetermined position to adjust for the size of a user's finger while being permanently secured to the shank member and the respective end members are moved relative to each other as the bridge member is moved relative to the shank member.

19. The jewelry ring of claim 18 wherein the bridge member includes a pair of extension members and a pair of securement members, the shank member has the pair of slots and the extension members extend through the slots.

20. The jewelry ring of claim 18 wherein the bridge member has the slots at respective ends, each slot encircles the shank member.

21. An adjustable jewelry device comprising:

a shank member configured to encircle a substantial portion of an appendage, the shank member includes a first end and a second end, the first end and the second end are spaced from each other to provide an opening, the shank member has a pair of elongated slots, each elongated slot is spaced from a respective end and positioned opposite to each other, the elongated slots extend through the shank member from an inside surface of the shank member to an outside surface; and a bridge member mounted within the opening and between the first and second ends which are exterior of the bridge member, portions of the bridge member extend through respectively the elongated slots to prevent any separation of the bridge member from the shank member, the shank member and the bridge member are dimensioned to provide a spring force between the shank member and the bridge member wherein the bridge member can be moved relative to the shank member between opposite ends of the respective elongated slots to change a distance between the first end and second end of the shank member and to adjust for the size of a user's appendage.

22. An adjustable jewelry device, comprising:

a shank member configured to encircle a substantial portion of an appendage, the shank member includes a first side member with a first end and a second side member with a second end, the first end and the second end are spaced from each other to provide an opening between the side members;

a bridge member mounted within the opening and below the first and second ends of the shank member which are exterior of the bridge member, the bridge member has a pair of elongated slots that extend from an upper surface of the bridge member through a lower surface of the bridge member, the elongated slots are spaced from each other and each of the first and second side members extends through a respective elongated slot in the bridge member, each end of the bridge member is slidably connected to the shank member in a manner to prevent any separation of the bridge member from the shank member, the shank member and the bridge member are dimensioned to provide a spring force between the shank member and the bridge member wherein the movement of the bridge member will vary a distance between the first end and the second end of the shank member to adjust for the size of a user's appendage.

* * * * *